US005178167A

United States Patent [19]

Riggs et al.

[11] Patent Number: 5,178,167

[45] Date of Patent: Jan. 12, 1993

[54] CARBONACEOUS COMPOSITION FOR FUEL ELEMENTS OF SMOKING ARTICLES AND METHOD OF MODIFYING THE BURNING CHARACTERISTICS THEREOF

[75] Inventors: Dennis M. Riggs, Belews Creek; Alvaro Gonzalez-Parra, Clemmons, both of N.C.

[73] Assignee: R. J. Reynolds Tobacco Company, Winston-Salem, N.C.

[21] Appl. No.: 722,993

[22] Filed: Jun. 28, 1991

[51] Int. Cl.[5] ..... A24B 15/16

[52] U.S. Cl. ..... 131/359; 131/352; 131/365; 131/369

[58] Field of Search ..... 131/359, 369, 365, 352

[56] References Cited

U.S. PATENT DOCUMENTS

| | | |
|---|---|---|
| 4,506,682 | 3/1985 | Muller . |
| 4,708,151 | 11/1987 | Shelar . |
| 4,714,082 | 12/1987 | Banerjee et al. . |
| 4,732,168 | 3/1988 | Resce . |
| 4,756,318 | 7/1988 | Clearman et al. . |
| 4,782,644 | 11/1988 | Haarer et al. . |
| 4,793,365 | 12/1988 | Sensabaugh et al. . |
| 4,802,568 | 2/1989 | Haarer et al. . |
| 4,807,809 | 2/1989 | Pryor . |
| 4,827,950 | 5/1989 | Banerjee et al. . |
| 4,854,331 | 8/1989 | Banerjee et al. . |
| 4,858,630 | 8/1989 | Banerjee et al. . |
| 4,870,748 | 10/1989 | Hensgen et al. . |
| 4,881,556 | 11/1989 | Clearman et al. . |
| 4,893,637 | 1/1990 | Hancock et al. . |
| 4,893,639 | 1/1990 | White . |
| 4,903,714 | 2/1990 | Barnes et al. . |
| 4,917,128 | 4/1990 | Clearman et al. . |
| 4,928,714 | 5/1990 | Shannon . |
| 4,938,238 | 7/1990 | Hancock et al. . |
| 4,986,286 | 1/1991 | Roberts et al. . |
| 4,989,619 | 2/1991 | Clearman et al. . |
| 4,991,596 | 2/1991 | Lawrence et al. . |
| 5,005,593 | 4/1991 | Fagg . |
| 5,027,837 | 7/1991 | Clearman . |

FOREIGN PATENT DOCUMENTS

| | | |
|---|---|---|
| 338831 | 4/1989 | European Pat. Off. . |
| 342538 | 5/1989 | European Pat. Off. . |

*Primary Examiner*—V. Millin
*Assistant Examiner*—J. Doyle
*Attorney, Agent, or Firm*—Grover M. Myers; David G. Conlin

[57] ABSTRACT

It has been found that the addition of specific levels of sodium, advantageously in the form of sodium carbonate, to low sodium level binder, e.g., ammonium alginate, containing carbonaceous fuel compositions results in dramatic changes in the performance of both the fuel element themselves and, cigarettes (or other smoking articles) incorporating the fuel elements. These performance differences include variation in the yields of aerosol and/or flavorants. The addition of sodium carbonate to the fuel elements greatly improves the smolder rates and also improves puff calories, without overheating the cigarette, thereby resulting in substantial improvements in total (and puff by puff) aerosol yield.

43 Claims, 11 Drawing Sheets

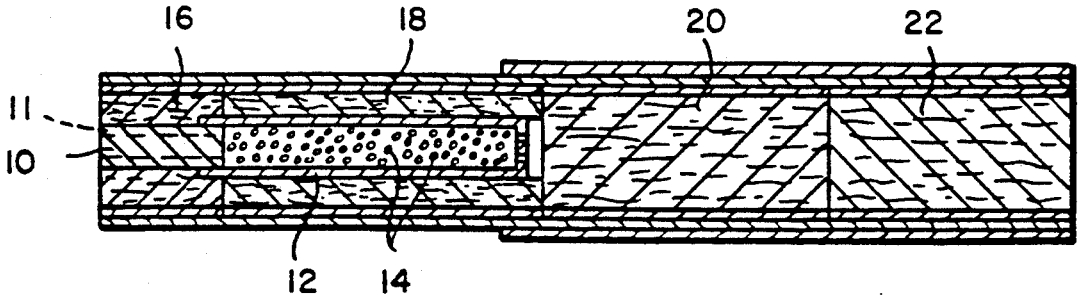
FIG. 1
FIG. 1A
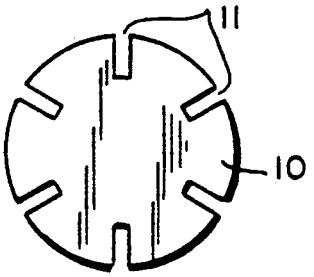
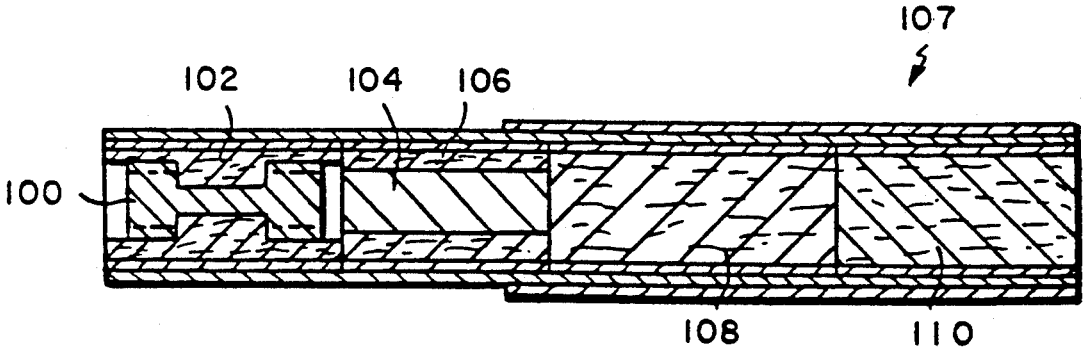
FIG. 2
FIG. 2A
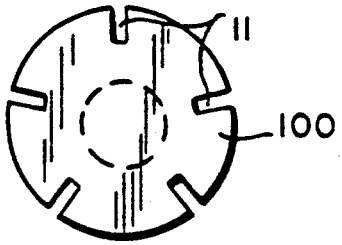

CARBONACEOUS COMPOSITION FOR FUEL ELEMENTS OF SMOKING ARTICLES AND METHOD OF MODIFYING THE BURNING CHARACTERISTICS THEREOF

BACKGROUND OF THE INVENTION

The present invention relates to smoking articles such as cigarettes, and in particular to those smoking articles having a short fuel element and a physically separate aerosol generating means. Smoking articles of this type, and methods and apparatus for preparing them are described in the following U.S. Pat. Nos. 4,708,151 to Shelar; 4,714,082 to Banerjee et al.; 4,732,168 to Resce; 4,756,318 to Clearman et al.; 4,782,644 to, Haaler et al.; 4,793,365 to Sensabaugh et al.; 4,802,568 to Haarer et al.; 4,827,950 to Banerjee et al.; 4,870,748 to Hensgen et al.; 4,881,556 to Clearman et al.; 4,893,637 to Hancock et al.; 4,893,639 to White; 4,903,714 to Barnes et al.; 4,917128 to Clearman et al.; 4,928,714 to Shannon; 4,938,238 to Barnes et al., and 4,989,619 to Clearman et al., as well as in the monograph entitled *Chemical and Biological Studies of New Cigarette Prototypes That Heat Instead of Burn Tobacco*, R. J. Reynolds Tobacco Company, 1988 (RJR Monograph). These smoking articles are capable of providing the smoker with the pleasures of smoking (e.g., smoking taste, feel, satisfaction, and the like).

Cigarettes, cigars and pipes are popular smoking articles which use tobacco in various forms. As discussed in the background sections of the aforementioned patents, many smoking articles have been proposed as improvements upon, or alternatives to, the various popular smoking articles.

The smoking articles described in the aforesaid patents and/or publications employ a combustible carbonaceous fuel element for heat generation and aerosol forming substances positioned physically separate from, and in a heat exchange relationship with the fuel element.

Carbonaceous fuel elements for such smoking articles typically comprise a mixture of carbon and a binder. Optional additives such as flame retardants, burn modifiers, carbon monoxide catalysts, and the like have also been employed in such fuel element compositions. Energy levels of such fuel elements, i.e., smolder heat and draw (or puffing) heat have often been difficult to control, and has largely been manipulated by modification of the fuel element design, e.g., the number of and placement of passageways through the fuel element and/or on the periphery thereof.

It would be advantageous to have an easier method of manipulating the energy levels of such carbonaceous fuel elements so that the design parameters of smoking articles employing such fuel elements can be varied based on a controlled amount of energy generated by the fuel elements.

Surprisingly, it has been discovered that the sodium content of carbonaceous fuel elements of the type described above is one factor controlling the energy levels of the fuel elements during puffing and smolder. It has also been discovered that the sodium content of these fuel elements has an effect on the lightability of such fuel elements.

The amount of sodium contained in the fuel elements, and the form in which the sodium is included in the manufacturing of the fuel element, have very substantial effects on the fuel element combustion characteristics.

Thus, the amount of sodium added during the manufacture of the fuel elements, and the form in which it is added, can be varied to improve performance of the smoking articles and increase control over the burning characteristics of the fuel elements.

SUMMARY OF THE INVENTION

The present invention is directed to novel compositions useful for the preparation of carbonaceous fuel elements for cigarettes and other smoking articles to achieve greater control over the burning characteristics of the fuel elements, to smoking articles such as cigarettes utilizing such fuel elements, and to methods of making such fuel elements.

One preferred fuel composition of the present invention comprises an intimate admixture of:

(a) from about 80 to 99 weight percent carbon;
(b) from about 1 to 20 weight percent of a binder; and
(c) a sodium (Na) level of from about 2000 to about 20,000 ppm.

Another preferred fuel composition of the present invention comprises an intimate admixture of:

(a) from about 60 to 98 weight percent carbon;
(b) from about 1 to 20 weight percent of a binder;
(c) from about 1 to 20 weight percent of tobacco; and
(d) a sodium (Na) content of from about 2000 to about 20,000 ppm.

Preferred embodiments of the present invention are carbonaceous fuel compositions which comprise a three-part mixture of (1) carbon, (2) a suitable binder, i.e., a non-sodium binder, which is preferred, a low-sodium binder, or a binder mixture having a controlled sodium level, and (3) if necessary, added sodium, e.g., via $Na_2CO_3$, to bring the sodium level to within the range of 2000 to 20,000 ppm.

If desired, a non-burning filler material such as calcium carbonate, agglomerated calcium carbonate, or the like, may be added to the fuel composition to assist in controlling the calories generated by the fuel element during combustion, by reducing the amount of combustible material present therein. The filler material typically comprises less than about 50 weight percent of the fuel composition, preferably less than about 30 weight percent, and most preferably from about 5 to about 20 weight percent.

Proper selection of the fuel composition used in the manufacture of the fuel permits the control of the energy transfer during puffing (e.g., convective heat), the energy transfer during smolder (e.g., radiative and/or conductive heat), improves the lightability of the fuel element and improves the overall aerosol generation of cigarettes employing the fuel elements, as well as providing other benefits.

The carbon used in the fuel composition can be any type of carbon, activated or unactivated, but is preferably a food grade carbon, having an average particle size of about 12 microns.

The binder useful herein are binders, or mixtures of binders, containing less than about 3000 ppm, most preferably less than about 1500 ppm of sodium (i.e., a low or non-sodium-based binder), and is preferably not a sodium salt material. Sodium naturally present in the binder (i.e., inherently present), if below about 3000 ppm, is acceptable. Binders which are acceptable include ammonium alginate, which is especially preferred, carboxymethyl cellulose, and the like. Sodium salt binders (such as sodium carboxymethyl cellulose), while not preferred, can be used, but should be diluted by admixture with other non-sodium or low sodium containing binders to reduce the total sodium content to within the desired range of 2000 to 20,000 ppm. It has been found that the sodium content of the ultimate fuel element, when derived from the sodium salt of the binder, is not as effective as sodium added to the fuel composition in other forms as provided by this invention.

Surprisingly, it has been found that not only is the level of sodium content in the ultimate fuel element important, but also the source of the sodium is of very great importance. The most preferred source of sodium for use in the fuel compositions of this invention is sodium carbonate ($Na_2CO_3$). The addition of sodium carbonate as an aqueous solution is effective in providing the requisite sodium levels in the fuel composition of the present invention. While using aqueous solutions of varying strengths (e.g., 0.1% -10%, preferably 0.5%-7%) is the preferred method of adding sodium to the fuel composition, other methods, e.g., dry admixture, can also be used if desired. In addition to sodium carbonate, other sodium compounds such as sodium acetate, sodium oxalate, sodium malate, and the like, may be used herein. However, sodium sources such as sodium chloride (NaCl) are not particularly effective.

As described above, deliberate variation of the sodium (Na) level in the fuel composition within the range of from about 2000 to 20,000 ppm (total Na content = inherent Na + added Na) allows the resulting fuel element to have selected and determinable burning properties.

Thus, the present invention is directed to a carbonaceous fuel composition which comprises from about 60 to about 99 weight percent carbon; from about 1 to about 20 weight percent of a suitable binder; and a sodium content ranging from about 2000 to about 10,000 ppm, as measured using inductively coupled plasma atomic emission spectroscopy (ICP-AES).

Other additives which can be included in the fuel composition of the present invention include compounds capable of releasing ammonia under the burning conditions of the fuel composition. Such compounds have been found useful in the fuel composition at from about 0.5 to 5.0%, preferably from about 1 to 4% and most preferably at from about 2 to 3% in reducing the levels of some carbonyl compounds in the combustion products of the burning fuel. Suitable compounds which release ammonia during the burning of the fuel composition include urea, inorganic and organic salts (e.g., ammonium carbonate, ammonium alginate, or mono-, di-, or tri-ammonium phosphate); amino sugars (e.g., prolino fructose or asparigino fructose); amino acids, particularly alpha amino acids (e.g., glutamine, glycine, asparagine, proline, alanine, cystine, aspartic acid, phenylalanine or glutamic acid); di-, or tri-peptides; quaternary ammonium compounds, and the like.

One especially preferred ammonia releasing compound is the amino acid asparagine. The addition of asparagine (Asn) in the fuel composition at from about 1% to about 3%, as a means to reduce carbonyl compounds produced during combustion is also considered a part of this invention.

In one preferred embodiment of the invention, when the sodium level of the fuel composition ranges from about 3500 to about 9,000 ppm, the fuel element is very easy to light.

In another embodiment of the present invention, the smolder rate of a burning carbonaceous fuel element can be controlled to be essentially as fast or as slow as desired, by modifying the sodium content of the fuel composition to within the range of from about 3000 to about 9000 ppm.

In another embodiment of the present invention the smolder temperature of a burning carbonaceous fuel element prepared from a composition comprising a mixture of carbon and a non-sodium based binder can be increased by adjusting the sodium content of the fuel element composition to within the range of between about 2500 and about 10,000 ppm.

In yet another embodiment of the present invention, the puff temperature of a burning carbonaceous fuel element prepared from a composition comprising a mixture of carbon and a non-sodium based binder can be controlled as desired (high/medium/low) by adjusting the sodium content of the fuel element composition mixture such that the sodium content falls between about 6500 and about 10,000 ppm.

BRIEF DESCRIPTION OF THE DRAWINGS

FIG. 1 illustrates the configuration of the cigarette described in the RJR Monograph (Reference Cigarette), with the fuel element cross-section modified as shown in FIG. 1A and having the fuel composition prepared according to the present invention.

FIG. 1A is a cross-section of the fuel element of the cigarette shown in FIG. 1.

FIG. 2 illustrates another embodiment of a cigarette which may employ a carbonaceous fuel element prepared from the fuel composition of the present invention.

FIG. 2A is a cross-section of the fuel element of the cigarette shown in FIG. 2.

DETAILED DESCRIPTION OF THE PREFERRED EMBODIMENTS

Figure 3:
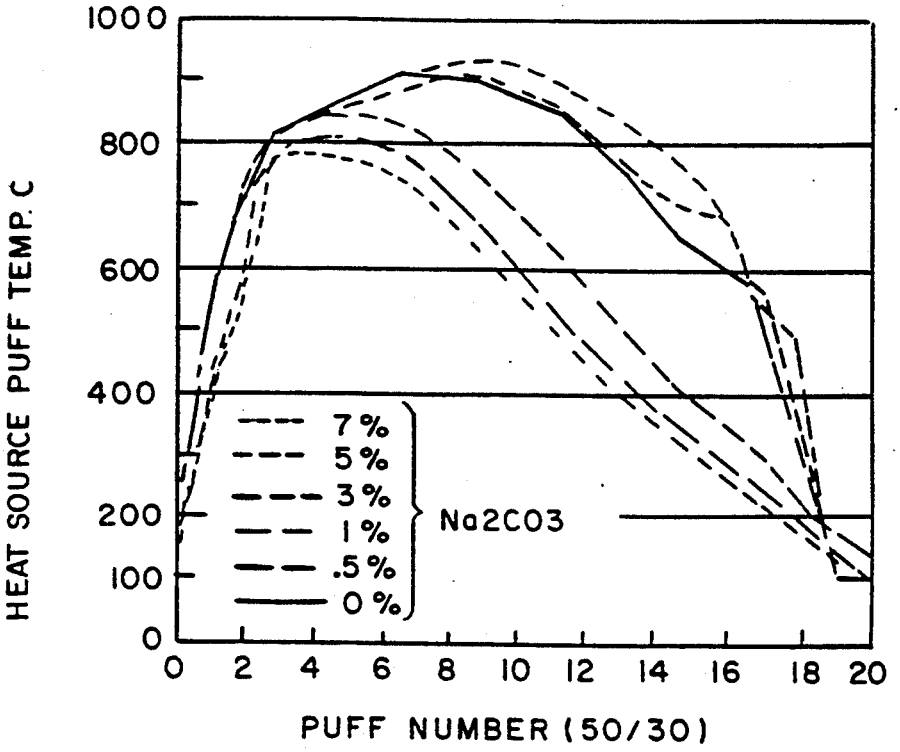
FIG. 3 shows the face temperatures during a puff of FIG. 1A fuel elements prepared with various levels of added $Na_2CO_3$ in aqueous solutions (0%, 0.5%, 1.0%, 3.0%, 5.0% and 7.0%).

As described above, the present invention is particularly directed to a fuel composition useful for fuel elements of smoking articles, such as the Reference Cigarette (FIG. 1) and other smoking articles, such as those described in U.S. Pat. Nos. 4,793,365; 4,928,714; 4,714,082; 4,756,318; 4,854,331; 4,708,151; 4,732,168; 4,893,639; 4,827,950; 4,858,630; 4,938,238; 4,903,714; 4,917,128; 4,881,556; 4,991,596; 5,027,837; U.S. patent application Ser. No. 07/642,233, filed 1/23/91; and U.S. patent application Ser. No. 07/723,350, filed concurrently herewith, which are incorporated herein by reference. See also, European Patent Publication No. 342,538.

FIGS. 1 and 1A are generally representative of a Reference Cigarette with a modified fuel element configuration, respectively. The cigarette has a carbonaceous fuel element 10 which is formed from the fuel composition of the present invention, circumscribed by a jacket of insulating glass fibers 16. Located longitudinally behind the fuel element, and in contact with a portion of the rear periphery thereof is a capsule 12. The capsule carries a substrate material 14 which contains aerosol forming materials and flavorants. Surrounding the capsule 12 is a roll of tobacco 18 in cut-filler form. The mouthend piece of the cigarette is comprised of two parts, a tobacco paper segment 20 and a low efficiency polypropylene filter material 22. As illustrated several paper layers are employed to hold the cigarette and its individual components together.

Heat from the burning fuel element is transferred by conduction and convection to the substrate in the capsule. During puffing the aerosol and flavorant materials carried by the substrate are condensed to form a smoke-like aerosol which is drawn through the smoking article, absorbing additional tobacco and other flavors from other components of the smoking article and exits the mouthend piece 22.

Referring in detail to FIGS. 2 and 2A, there is illustrated another cigarette design and fuel element therefor, which can employ the fuel composition of the present invention. As illustrated, the cigarette includes a segmented carbonaceous fuel element 100 surrounded by a jacket of insulating material 102. The insulating material 102 may be glass fibers or tobacco, treated to be substantially nonburning. As shown, the insulating material 102 extends beyond each end of the fuel element. In other words, the fuel element is recessed within the insulating jacket. Situated longitudinally behind the fuel element 100 is a substrate 104, advantageously made from a roll or gathered web of cellulosic material, e.g., paper or tobacco paper. This substrate 104 is circumscribed by a resilient jacket 106 which may advantageously comprise glass fibers, tobacco, e.g., in cut filler form, or mixtures of these materials. Located behind the substrate is a mouthend piece 107 comprising two segments, a tobacco paper segment 108 and a low efficiency polypropylene filter segment 110. Several layers of paper are employed to hold the cigarette and its individual components together.

In a less preferred embodiment (not shown), but similar to the embodiment shown in FIG. 2, the substrate (e.g., a gathered paper) can be positioned within a tube which in turn is circumscribed by tobacco cut filler or insulating material. The tube has sufficient length to extend through the void space between the back end of the fuel element and the front end of the substrate and surround a portion of the length of the back end of the fuel element. As such, the tube is positioned between the insulating jacket and the fuel element, and circumscribes and contacts the back end of the fuel element. The tube is preferably manufactured from a non-wicking, heat resistant material (e.g., is a heat resistant plastic tube, a treated paper tube, or a foil-lined paper tube).

As in the cigarette of FIG. 1, heat from the burning fuel element in this cigarette is transferred to the substrate. In this cigarette, however, convective heat is the predominant mode of energy transfer. This heat volatilizes the aerosol and flavorant materials carried by the substrate and condensed to form a smoke-like aerosol which is drawn through the smoking article, during puffing, and exits the mouthend piece 106.

Other smoking articles which may successfully employ the fuel composition of the present invention are described in the patents which have previously been incorporated herein by reference.

In many of the previously mentioned patents, the carbonaceous fuel elements for the smoking articles, use a sodium carboxymethylcellulose (SCMC) binder, at about 10% by weight, in intimate admixture with about 90% by weight carbon powder. Fuel elements prepared from this composition have the following physical characteristics; (1) they are sometimes difficult to light; (2) they burn very hot; (3) they burn very fast; (4) they can generate high levels of carbon monoxide Attempts at improving the characteristics of these fuel elements led to the present invention, wherein it has been found through elemental analysis of the fuel composition, that the sodium level in the fuel composition was one factor responsible for the burning characteristics of the fuel composition.

The following table provides the elemental analysis of cationic impurities present in blended fuel element compositions consisting of carbon (90%) and a gradient of two binders, SCMC and ammonium alginate (Alg). From Table 1 it will be noted that the all-SCMC binder has a base-line sodium level of 7741 ppm, while the base-line sodium level in the all-alginate binder is only 2911 ppm. It has been found that by varying the sodium level in the fuel composition, e.g., by blending high and low sodium level binders, or more preferably, by using a low sodium level binder and adding sodium compounds such as sodium carbonate, sodium acetate, sodium oxalate, sodium malate, and the like, variation in the burning characteristics of the fuel element may be achieved, and tailored to meet the energy requirements of any smoking article.

TABLE 1

| Element | 10% SCMC 0% Alg ppm | 8% SCMC 2% Alg ppm | 6% SCMC 4% Alg ppm | 4% SCMC 6% Alg ppm | 2% SCMC 8% Alg ppm | 0% SCMC 10% Alg ppm |
|---|---|---|---|---|---|---|
| | Elemental Analysis* of Cations in Carbon/Binder Fuel Elements | | | | | |
| Al | 6588 | 11170 | 1165 | 862 | 684 | 522 |
| Ca | 1583 | 1809 | 1954 | 2046 | 2316 | 2500 |
| Cr | 17 | 22 | 11 | 14 | 10 | 20 |
| Cu | 0.9 | 1 | 1 | 1 | 0.9 | 1 |
| Fe | 350 | 457 | 334 | 494 | 463 | 491 |
| K | 242 | 351 | 83 | 72 | 65 | 51 |
| Mg | 695 | 710 | 735 | 712 | 717 | 706 |
| Mn | 9 | 10 | 8 | 9 | 9 | 9 |
| Na | 7741 | 6794 | 6116 | 5550 | 3931 | 2911 |
| Ni | 3 | 4 | 3 | 3 | 3 | 4 |
| P | 15 | 26 | 9 | 6 | 7 | 9 |
| S | 100 | 135 | 138 | 156 | 195 | 221 |
| Si | 194 | 142 | 112 | 422 | 206 | 169 |
| Sr | 9 | 15 | 28 | 36 | 46 | 57 |
| Zn | 4 | 3 | 3 | 3 | 3 | 3 |

*measured using inductively coupled plasma atomic emission spectroscopy

As described above, one principal constituent of the fuel element composition of the present invention is a carbonaceous material. Preferred carbonaceous materials have a carbon content above about 60 weight percent, more preferably above about 75 weight percent, and most preferably above about 85 weight percent.

Carbonaceous materials are typically provided by carbonizing organic matter. One especially suitable source of such organic matter is hardwood paper pulp. Other suitable sources of carbonaceous materials are coconut hull carbons, such as the PXC carbons available as PCB and the experimental carbons available as Lot B-11030-CAC-5, Lot B-11250-CAC-115 and Lot 089-A12-CAC-45 from Calgon Carbon Corporation, Pittsburgh, Penna.

Fuel elements may be prepared from the composition of the present invention by a variety of processing methods, including, molding, machining, pressure forming, or extrusion, into the desired shape. Molded fuel elements can have passageways, grooves or hollow regions therein.

Preferred extruded carbonaceous fuel elements can be prepared by admixing up to 95 parts carbonaceous material, up to 20 parts binding agent and up to 20 parts tobacco (e.g., tobacco dust and/or a tobacco extract) with sufficient aqueous $Na_2CO_3$ solution (having a preselected solution strength) to provide an extrudable mixture. The mixture then can be extruded using a ram or piston type extruder or a compounding screw extruded into an extrudate of the desired shape having the desired number of passageways or void spaces.

As described above, a non-burning filler material such as calcium carbonate, agglomerated calcium carbonate, or the like, may be added to the fuel composition to assist in controlling the calories generated by the fuel element during combustion, by reducing the amount of combustible material present therein. The filler material typically comprises less than about 50 weight percent of the fuel composition, preferably less than about 30 weight percent, and most preferably from about 5 to about 20 weight percent. For details regarding such fillers, see U.S. patent application Ser. No. 07/567,520, filed 8/15/90.

As described above, the fuel composition of the present invention can contain tobacco. The form of the tobacco can vary, and more than one form of tobacco can be incorporated into the fuel composition, if desired. The type of tobacco can vary, and includes flue-cured, Burley, Md. and Oriental tobaccos, the rare and specialty tobaccos, as well as blends thereof.

One suitable form of tobacco for inclusion in the fuel composition is a finely divided tobacco product that includes both tobacco dust and finely divided tobacco laminae.

Another form of tobacco useful in the fuel composition is a tobacco extract or mixtures of tobacco extracts. Tobacco extracts typically are provided by extracting a tobacco material using a solvent such as water, carbon dioxide, sulfur hexafluoride, a hydrocarbon such as hexane or ethanol, a halocarbon such as a commercially available Freon, as well as other organic and inorganic solvents. Tobacco extracts can include spray dried tobacco extracts, freeze dried tobacco extracts, tobacco aroma oils, tobacco essences and other types of tobacco extracts. Methods for providing suitable tobacco extracts are set forth in U.S. Pat. Nos. 4,506,682 to Muller, 4,986,286 to Roberts et al., and 5,005,593 to Fagg; European Patent Publication No. 338,831; and U.S. patent application Ser. Nos. 07/452,175, filed Dec. 18, 1989, 07/536,250, filed June 11, 1990, 07/680,207, filed Apr. 4, 1991, 07/709,959, filed June 4, 1991, 07/710,273, filed June 4, 1991, and U.S. patent application Ser. No. 07,717,457.

Suitable binders for use in the present composition do not appreciably add sodium to the fuel composition. Carbon and binder based fuel compositions having a base-line sodium level of about 3000 ppm Na or less are desired. This base-line limitation on the Na level allows the controlled addition of desired levels of sodium by the addition of aqueous $Na_2CO_3$, and the resulting fuel elements have pronounced benefits therefrom. Thus, sodium salts, unless diluted, do not generally qualify as binders herein. Binders having other cationic species, e.g., potassium, ammonium, etc. are generally acceptable.

The preferred method of adding sodium to the non-sodium based binders (or low sodium content binders) is by mixing an aqueous solution of the sodium compound with the binder and the carbonaceous material. Preferably, the strength of the aqueous solution ranges from about 0.1 to 10 weight percent, most preferably from about 0.5 to 7 weight percent. While the most preferred source of sodium for use in the fuel compositions of this invention is sodium carbonate ($Na_2CO_3$), other useful sodium compounds sodium acetate, sodium oxalate, sodium malate, and the like. While not preferred, dry admixture (with adequate mixing) can distribute the sodium compounds into the binder and carbonaceous material, forming a suitable composition.

The most preferred non-sodium based binder for the fuel compositions of the present invention is ammonium alginate HV obtained from Kelco Co. of San Diego, Calif. Other useful non-sodium based binders include the polysaccharide gums, such as the plant exudates; Arabic, Tragacanth, Karaya, Ghatti; plant extracts, pectin, arabinoglactan; plant seed flours, locust been, guar, alginates, carrageenan, furcellaran, cereal starches, corn, wheat, rice, waxy maize, sorghum, waxy sorghum, tuber starches, potato, arrowroot, tapioca; the microbial fermentation gums, Xanthan and dextran; the modified gums including cellulose derivatives, methylcellulose, carboxy methylcellulose, hydroxypropyl cellulose, and the like.

The present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius.

EXAMPLE 1

Six sets of fuel elements were fabricated in which varying levels of sodium carbonate were added to the extrusion mix.

The fuel elements were fabricated from a blend containing 90% by weight of Kraft hardwood carbonized pulp ground to an average particle size of 12 microns (as measured using a Microtrac) and 10% Kelco HV ammonium alginate binder. This blend of carbon powder and binder was mixed together with aqueous solutions of sodium carbonate of varying strength to form extrusion mixtures from which the fuel elements were processed into their final form. Approximately 30% by weight of each $Na_2CO_3$ solution was added to each blend to form the various extrusion mixtures.

The hardwood pulp carbon was prepared by carbonizing a non-talc containing grade of Grand Prairie Canadian Kraft hardwood paper under a nitrogen blanket, increasing the temperature in a step-wise manner sufficient to minimize oxidation of the paper, to a final carbonizing temperature of at least 750° C. The resulting carbon material was cooled under nitrogen to less than about 35° C., and then ground to fine powder having an average particle size of about 12 microns in diameter.

The $Na_2CO_3$ solution strengths used in forming the extrusion mixtures were: (a) 0%, the control, (b) 0.5%, (c) 1.0%, (d) 3.0%, (e) 5.0%, and (f) 7.0% sodium carbonate by weight in water.

The fuel mixture was extruded using a ram extruder, providing fuel rods having 6 equally spaced peripheral passageways in the form of slots or grooves, each having a depth of about 0.035 inch and a width of about 0.027 inch. The configuration of the passageways (slots) which extend longitudinally along the periphery of the fuel element are substantially as shown in FIG. 1A. After extrusion, the wet fuel rods were dried to a moisture level of about 4.0%. The resulting dried rods were cut into 10 mm lengths, thereby providing fuel elements.

The physical characteristics of the dried and cut fuel elements are shown below in Table 2.

TABLE 2

| Fuel Element Physical Characteristics Sodium Carbonate Additive | Solution Strength | | | | | |
|---|---|---|---|---|---|---|
| | 0% | 0.5% | 1.0% | 3.0% | 5.0% | 7.0% |
| Diameter (in) | 0.176 | 0.173 | 0.174 | 0.174 | 0.175 | 0.172 |
| Dry wt. (mg) | 111.94 | 108.96 | 107.12 | 106.95 | 110.82 | 114.77 |
| 75° F./40 RH Moisture* | 4.27 | — | 3.93 | 3.92 | 4.09 | 4.46 |
| Length (mm) | 10 | 10 | 10 | 10 | 10 | 10 |

*Moisture picked up after conditioning at 75° F. and 40% relative humidity for four days.

EXAMPLE 2

The fuel elements prepared in Example 1 were subjected to inductively coupled plasma atomic emission spectroscopy (ICP-AES) to determine the elemental compositions thereof.

Table 3 provides the results of the ICP-AES analysis on the 6 different sets of fuel elements produced in Example 1. From Table 3 it can be seen that the sodium carbonate solutions result in significantly different pick-ups of sodium by the fuel elements depending upon the strength of the solution used. Sodium contents range from 1120 ppm for the control (i.e., the inherent amount) to 17,420 ppm for ammonium alginate fuel elements produced using the 7% sodium carbonate solution.

TABLE 3

| ICP-AES Analysis of Fuel Elements Effect of Sodium Carbonate Solutions During Processing | | | | | | |
|---|---|---|---|---|---|---|
| Element | 0% Sol'n ppm | 0.5% Sol'n ppm | 1.0% Sol'n ppm | 3.0% Sol'n ppm | 5.0% Sol'n ppm | 7.0% Sol'n ppm |
| Al | 276 | 221 | 173 | 161 | 183 | 126 |
| Ba | 14 | 13 | 12 | 12 | 12 | 11 |
| Ca | 2317 | 2200 | 2120 | 2084 | 2038 | 1978 |
| Cr | 25 | 13 | 13 | 12 | 11 | 11 |
| Cu | 1 | 0.9 | 0.9 | 0.7 | 0.8 | 0.7 |
| Fe | 442 | 242 | 205 | 228 | 173 | 169 |
| K | 330 | 120 | 109 | 90 | 34 | 82 |
| Mg | 653 | 613 | 608 | 583 | 560 | 536 |
| Mn | 7 | 5 | 4 | 4 | 4 | 4 |
| Na | 1120 | 2234 | 3774 | 8691 | 13150 | 17420 |
| Ni | 3 | 3 | 3 | 2 | 3 | 2 |
| P | 27 | 18 | 12 | 9 | 10 | 3 |
| S | 270 | 267 | 211 | 208 | 229 | 211 |
| Sr | 60 | 61 | 56 | 56 | 55 | 54 |
| Zn | 4 | 4 | 4 | 4 | 4 | 4 |

EXAMPLE 3

Lighting tests on the different sets of fuel elements prepared in Example 1 were conducted using a computer driven smoking machine and air piston apparatus.

In this test, a fuel element was placed into an empty aluminum capsule which was then surrounded by a C-glass insulation jacket. This assembly was then placed into a holder which was driven into a propane flame by the computer actuated piston for 2.4 seconds. A 50 cc puff, of two (2) seconds duration, was taken while the fuel element was in the flame. The piston then withdrew the assembly from the flame and a second 50 cc puff was taken.

Temperature measurements of the fuel element are then monitored by an infrared camera assembly (Heat Spy). After the initial 2 puffs, a total of 4 more 50 cc puffs were applied to the assembly while temperatures of the fuel element were constantly monitored.

A fuel element was considered to be lit if after all 6 puffs, the face temperature was above 200° C. A fuel element was considered to be partially lit if the face temperature of the fuel element was above 200° C after puff 4 but below 200° C. by puff 6. A fuel element was considered non-lit when it had a temperature below 200° C. by puff 4.

When testing the fuel elements, a total of 10 from each $Na_2CO_3$ level were exposed to the test to determine average lightability of that group.

It was found that the ammonium alginate fuel elements containing no extra sodium would not light under the test conditions 100% of the time. The use of a 1% sodium carbonate solution during mixing of the fuel element ingredients however, resulted in 60% of the fuel elements fully lighting, 10% partially lighting, and only 30% not lighting under the same test conditions. By using a 30% solution of sodium carbonate in the mix, the percentage of fuel elements which would not light dropped to 10%. Further additions of sodium carbonate to the mixes resulted in a decline in lightability.

This example shows conclusively that the addition of sodium through the use of an aqueous sodium carbonate solution to the fuel elements provides dramatic improvements in the lightability of the fuel element. There does seem to be a point however, where further additions of sodium to the fuel elements results in a diminishment of lighting tendencies.

From these data, the optimum strength of the sodium carbonate solution to add to the fuel element to improve the lighting ability of fuel elements having the slot pattern of FIG. 1A is in the range of 1-3% which translates to a sodium content in the fuel element that lies between 3800-8700 ppm.

In another lightability test, a modified fuel element of the Reference Cigarette (having the FIG. 1A slot pattern) was compared to the fuel elements of the present invention. The Reference Cigarette fuel element was 10 mm in length and 4.5 mm in diameter, with a composition of 9 parts hardwood carbon, 1 part SCMC binder, and 1 wt.% $K_2CO_3$, which was baked prior to use at a temperature in excess of 800° C. for two hours to carbonize the binder and to reduce or eliminate any volatile compounds therein.

Fuel elements prepared as in Example 1, having from about 3500 to about 9000 ppm Na were found to light nearly 100% of the time, while the Reference Cigarette fuel elements only lighted from about 10 to about 25% of the time.

EXAMPLE 4

The smoldering tendency of a fuel element described in Example 1 was measured by placing a fuel element in an empty capsule, lighting it, and then monitoring its weight loss, as an indication of how fast the fuel element will burn during smolder periods in a lit cigarette. This also provides a relative measure of the rate of conductive energy transfer to the capsule during smolder.

Ammonium alginate fuel elements containing no added sodium burn very slowly during the smolder period. The addition of sodium accelerates the burn rate depending upon the amount of sodium added to the fuel element. The amount of carbon burned increased rapidly up to about a 3.0% sodium carbonate solution concentration. Further increases in added sodium results in only marginally higher smolder rates compared to the fuel elements made with the 3% solution.

These data are significant because they demonstrate that it is possible to control the smolder rates of the fuel elements, and thus their conductive energy transfer to the capsule, by adjusting the sodium content.

EXAMPLE 5

The fuel elements of Example 1 were subjected to further analysis including:

(a) measurement of the fuel element face temperatures;
(b) measurement of the fuel element backside temperatures,
(c) measurement of the capsule temperatures,
(d) measurement of the aerosol temperatures, and
(e) measurement of the finger temperatures.

These studies were conducted on a puff by puff basis employing smoking conditions consisting of a 50 cc puff of two (2) seconds duration, every 30 seconds. This test method is referred to hereinbelow as the "50/30" test.

Shown in FIG. 3 are the face temperatures exhibited by the burning fuel elements of Example 1 during puffing. These temperatures were measured using an infrared Heat Spy camera focussed on the front of the fuel element.

As illustrated in FIG. 3, the fuel element temperature readings essentially fall into one of two groups. The fuel element having no added sodium carbonate (the control—i.e., 0% added $Na_2CO_3$ solution) exhibits the typical behavior of a 100% ammonium alginate binder carbon fuel element; i.e., the puff temperatures are high over the entire puffing schedule.

With small additions of sodium carbonate to the fuel element (i.e., 0.5%-1.0% $Na_2CO_3$ solution), very little difference is noted in the puff temperatures compared to the control. However, when a 3.0% or greater solution of sodium carbonate is used in manufacturing the fuel elements, a dramatic change in the puff temperatures is found to occur. The puff temperatures show a substantial decline compared to the control and exhibit temperatures much more like those associated with an SCMC binder fuel element.

Figure 4:
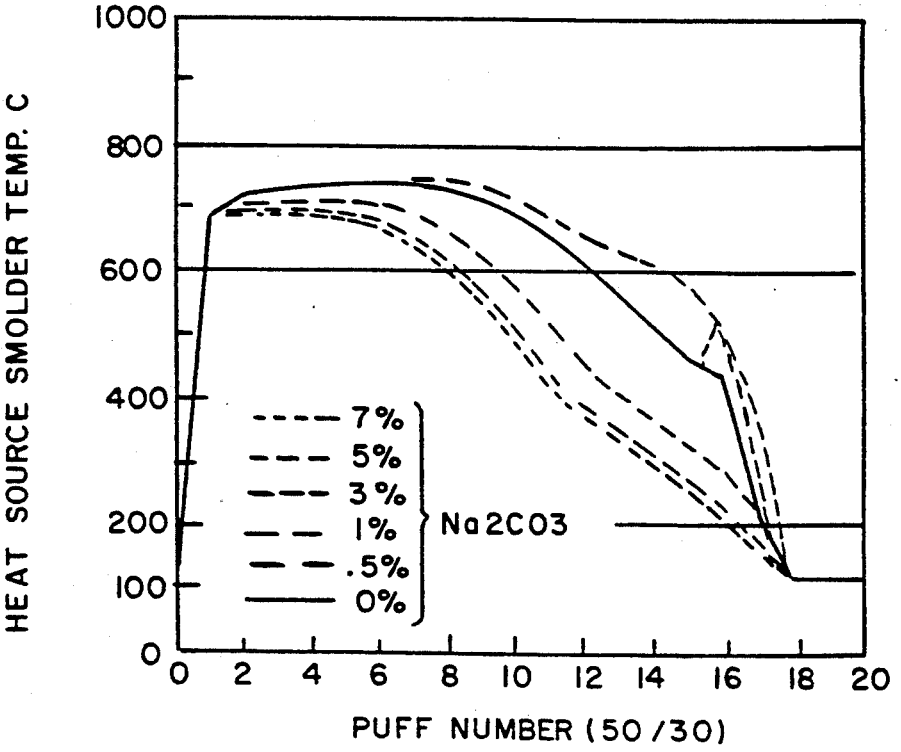
FIG. 4 shows the smolder temperatures of FIG. 1A fuel elements prepared with various levels of added $Na_2CO_3$ in aqueous solutions (0%, 0.5%, 1.0%, 3.0%, 5.0% and 7.0%) measured 15 seconds after a puff has been taken.

FIG. 4 shows the smolder temperatures of the fuel elements measured 15 seconds after the puff has been taken. These data are identical to the data shown for the puff temperatures discussed above in FIG. 3.

The smolder temperatures of the fuel elements having the higher sodium content are lower than those having little or no added sodium. However, it must be noted that despite the low smolder temperatures, the rate of smolder is actually greater when higher levels of sodium are present. More carbon is burning at any given point in the smolder when high levels of sodium carbonate have been added to the fuel element even though the overall combustion temperature is lower.

Figure 5:
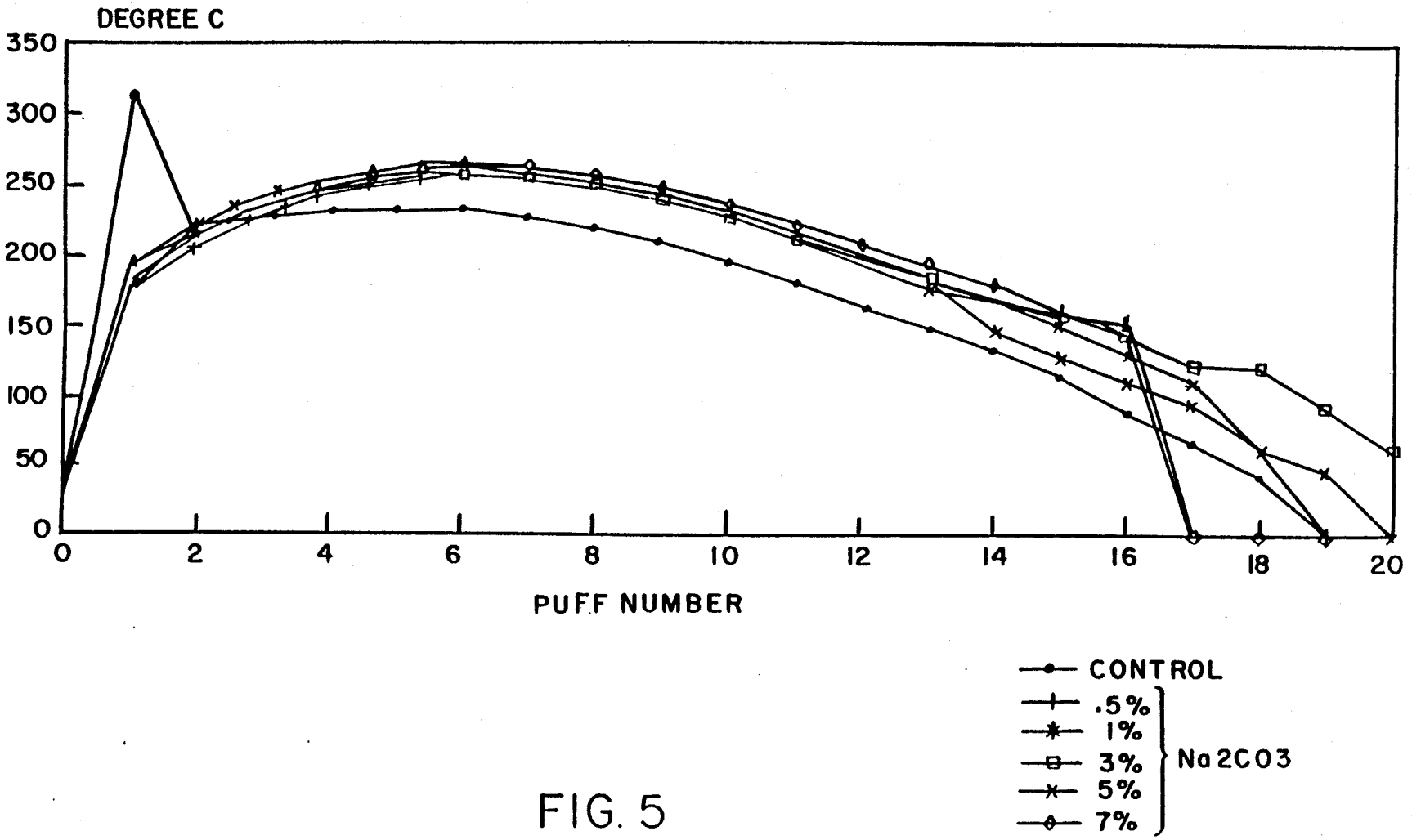
FIG. 5 illustrates the "backside" temperatures of FIG. 1A fuel elements prepared with various levels of added $Na_2CO_3$ in aqueous solutions (0%, 0.5%, 1.0%, 3.0%, 5.0% and 7.0%).

FIG. 5 illustrates the backside temperatures of the burning fuel elements of Example 1 as measured by inserting a thin wire thermocouple into the capsule against the back of the fuel element. The data of this figure show that the control fuel element (which has no added sodium) has a lower backside temperature (approx. 40° C.) over the majority of puffs compared to the same type of fuel element with added sodium. Those fuel elements having the added sodium all behave in a more or less identical fashion.

Figure 6:
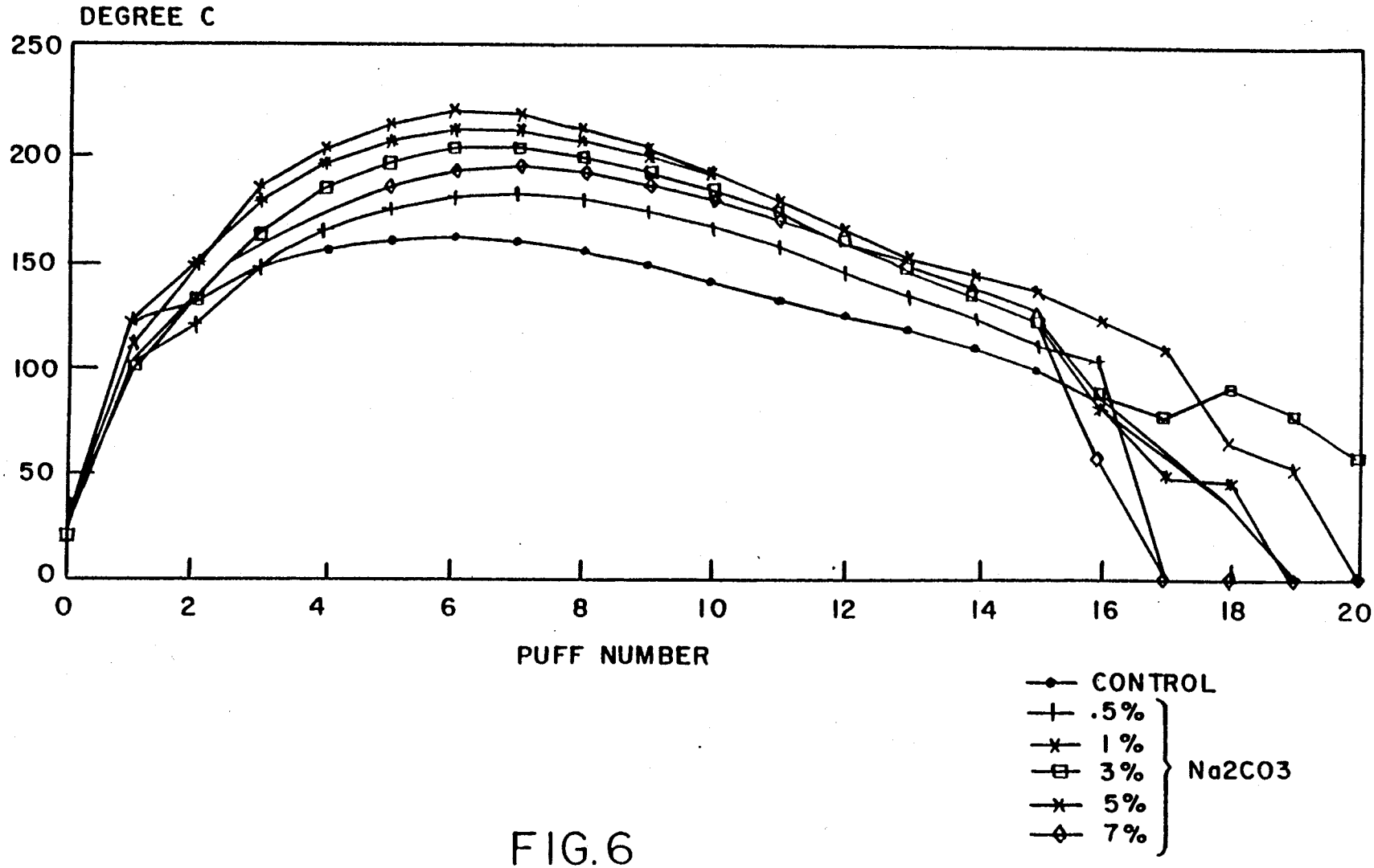
FIG. 6 provides the capsule wall temperatures of capsules fitted with FIG. 1A fuel elements prepared with various levels of added $Na_2CO_3$ in aqueous solutions (0%, 0.5%, 1.0%, 3.0%, 5.0% and 7.0%).

FIG. 6 illustrates the capsule wall temperatures as measured at a point 11 mm from the front end of the fuel element. In this analysis, the fuel elements were mounted in a 30 mm×4.5 mm (i.d.) aluminum capsule, filled to a depth of 25 mm with marumerized tobacco substrate (see, White, U.S. Pat. No. 4,893,639), and the combination was overwrapped with a C-glass insulating jacket.

The temperature measurements were obtained by inserting a thin wire thermocouple through the jacket to a point where the tip of the thermocouple was touching the capsule. The insertion hole was resealed before smoking with a caulking compound. FIG. 6 shows that the control fuel elements result in a capsule temperature that is substantially lower than that observed when fuel elements with sodium additives are used.

Fuel elements produced with aqueous $Na_2CO_3$ solutions ranging from 1.0%–5.0% sodium carbonate afforded capsule temperatures that are about 50° C. hotter than the control (0% added). This fact supports the hypothesis that the more rapid smolder rate of the sodium bearing fuel elements provides more conductive heat to the capsule and therefore, more adequately maintains the cigarette operating temperatures than does the control SCMC binder fuel element.

Figure 7:
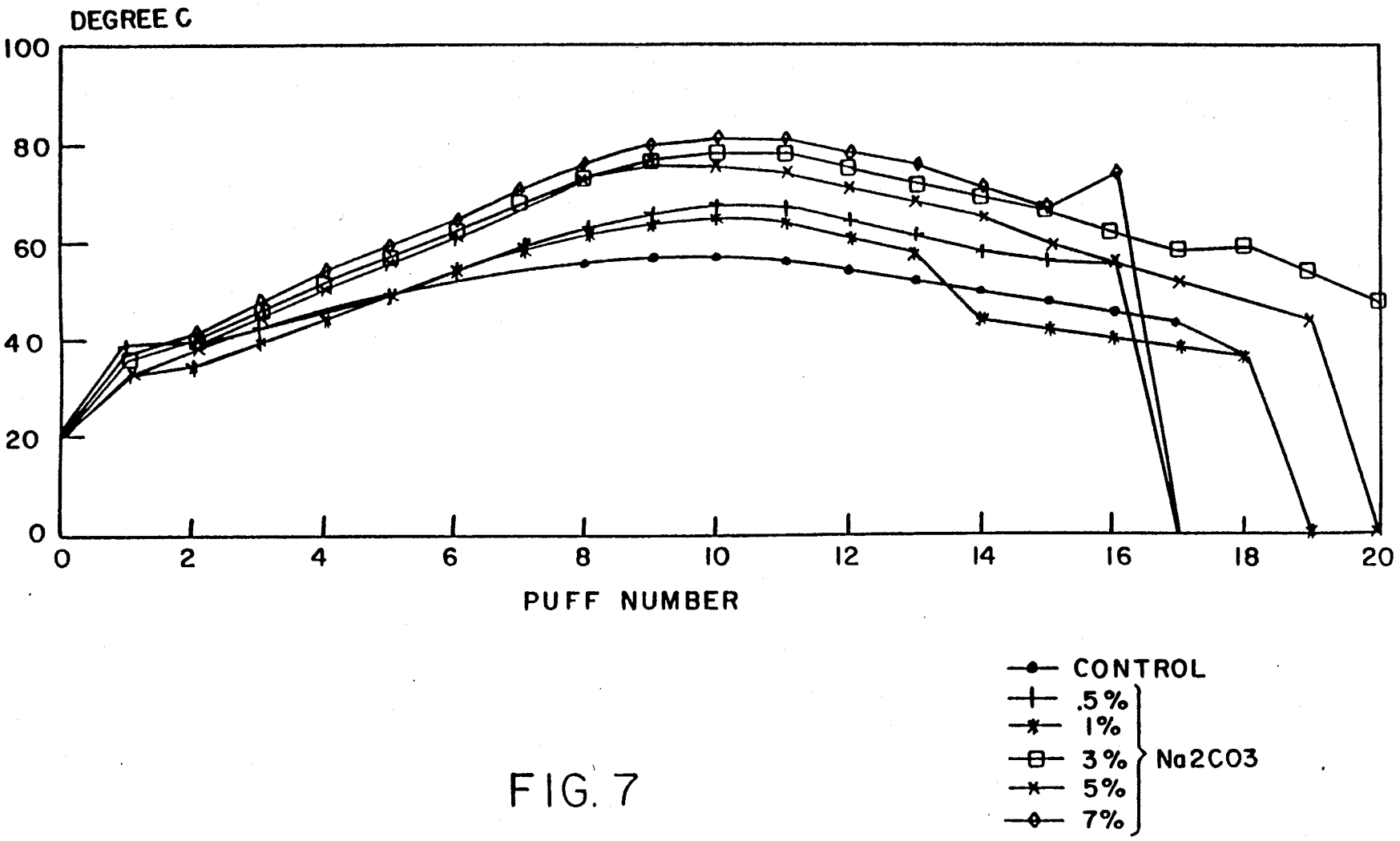
FIG. 7 provides plots of the puff by puff exit gas temperatures as determined at the rear of the capsules used in FIG. 6.

FIG. 7 is a plot of the puff by puff exit gas temperatures as determined at the rear of the capsules. In this analysis, the fuel elements were again mounted in a 30×4.5 mm (i.d.) aluminum capsule, filled to a depth of 25 mm with marumerized tobacco substrate (see, White, U.S. Pat. No. 4,893,639), and the combination was overwrapped with a C-glass insulating jacket.

In general, it can be seen that the addition of sodium carbonate to the composition used to prepare the fuel elements results in an increase in the temperature of the aerosol that is existing the capsule. High levels of sodium result in about a 20° C. increase in the temperature of the aerosol compared to the control.

EXAMPLE 6

Cigarettes substantially as described in FIG. 1, were fabricated with the fuel elements of Examples 1–5, using the following component parts:

1. 30 mm long slotted aluminum capsule filled to a depth of 25 mm with densified (i.e., marumerized) tobacco substrate,
2. 15 mm C-glass fuel element insulating jackets,
3. 22 mm long tobacco roll around the capsule, and
4. a mouthend piece consisting of a 20 mm long section of 4 inch wide gathered tobacco paper and 20 mm of polypropylene filter material.

Substrate Preparation

The substrate was a densified (or marumerized) tobacco, produced by extruding a paste of tobacco and glycerin onto a rapidly spinning disk which results in the formation of small, roughly spherical balls of the substrate material. The process is generally described and the apparatus is identified in U.S. Pat. No. 4,893,639 (White), the disclosure of which is incorporated herein by reference.

Aluminum Capsule

A hollow aluminum capsule was manufactured from aluminum using a metal drawing process. The capsule had a length of about 30 mm, an outer diameter of about 4.6 mm, and an inner diameter of about 4.4 mm. One end of the container was open; and the other end was sealed, except for two slot-like openings, which were about 0.65 mm by 3.45 mm in size and spaced about 1.14 mm apart.

The capsule was filled with the densified tobacco substrate to a depth of about 25 mm. The fuel element was then inserted into the open end of the container to a depth of about 3 mm. As such, the fuel element extended about 7 mm beyond the open end of the capsule.

Insulating Jacket

A 15 mm long, 4.5 mm diameter plastic tube is overwrapped with an insulating jacket material that is also 15 mm in length. In these cigarette embodiments, the insulating jacket is composed of one layer of Owens-Corning C-glass mat, about 2 mm thick prior to being compressed by the jacket forming machine. The final diameter of the jacketed plastic tube is about 7.5 mm.

Tobacco Roll

A tobacco roll consisting of volume expanded blend of Burley, flue cured and oriental tobacco cut filler is wrapped in a paper designated as P1487-125 from Kimberly-Clark Corp., thereby forming a tobacco roll having a diameter of about 7.5 mm and a length of about 22 mm.

Front End Assembly

The insulating jacket section and the tobacco rod are joined together by a paper overwrap designated as P2674-190 from Kimberly-Clark Corp., which circumscribes the length of the tobacco/glass jacket section as well as the length of the tobacco roll. The mouth end of the tobacco roll is drilled to create a longitudinal passageway therethrough of about 4.6 mm in diameter. The tip of the drill is shaped to enter and engage the plastic tube in the insulating jacket. The cartridge assembly is inserted from the front end of the combined insulating jacket and tobacco roll, simultaneously as the drill and the engaged plastic tube are withdrawn from the mouth end of the roll. The cartridge assembly is inserted until the lighting end of the fuel element is flush with the front end of the insulating jacket. The overall length of the resulting front end assembly is about 37 mm.

Mouthend Piece

The mouthend piece includes a 20 mm long cylindrical segment of a loosely gathered tobacco paper and a 20 mm long cylindrical segment of a gathered web of non-woven, melt-blown polypropylene, each of which includes an outer paper wrap. Each of the segments are provided by subdividing rods prepared using the apparatus described in U.S. Pat. No. 4,807,809 (Pryor et al.).

The first segment is about 7.5 mm in diameter, and is provided from a loosely gathered web of tobacco paper available as P1440-GNA from Kimberly-Clark Corp. which is circumscribed by a paper plug wrap available as P1487-184-2 from Kimberly-Clark Corp.

The second segment is about 7.5 mm in diameter, and is provided from a gathered web of non-woven polypropylene available as PP-100 from Kimberly-Clark Corp. which is circumscribed by a paper plug wrap available as P1487-184-2 from Kimberly-Clark Corp.

The two segments are axially aligned in an abutting end-to-end relationship, and are combined by circumscribing the length of each of the segments with a paper overwrap available as L-1377-196F from Simpson Paper Company, Vicksburg, Mich. The length of the mouthend piece is about 40 mm.

Final Assembly of Cigarettes

The front end assembly is axially aligned in an abutting end-to-end relationship with the mouthend piece, such that the container end of the front end assembly is adjacent to the gathered tobacco paper segment of the mouthend piece. The front end assembly is joined to the mouthend piece by circumscribing the length of the mouthend piece and a 5 mm length of the front end assembly adjacent the mouthend piece with tipping paper.

Final Conditioning

All finished cigarettes were conditioned from 4–5 days at 75° F./40% relative humidity (RH) prior to smoking.

Use

In use, the smoker lights the fuel element with a cigarette lighter and the fuel element burns. The smoker inserts the mouth end of the cigarette into his/her lips, and draws on the cigarette. A visible aerosol having tobacco flavor is drawn into the mouth of the smoker.

EXAMPLE 7

Like the fuel elements of Example 1, the cigarettes of Example 6 were also subjected to detailed analysis, including:

(a) measurement of capsule exit gas temperatures,
(b) measurement of mouthend piece finger temperatures,
(c) measurement of the $CO/CO_2$ yields,
(d) measurement of the total calorie output,
(e) measurement of the lit pressure drop,
(f) measurement of puff by puff aerosol density,
(g) measurement of total aerosol yield,
(h) measurement of puff by puff glycerine yield,
(i) measurement of total glycerine yield,
(j) measurement of puff by puff nicotine yield,
(k) measurement of total nicotine yield, These studies were conducted on a puff by puff basis employing one (or both) of two types of smoking conditions; (1) the "50/30" test described above, and (2) FTC smoking conditions.

Figure 8:
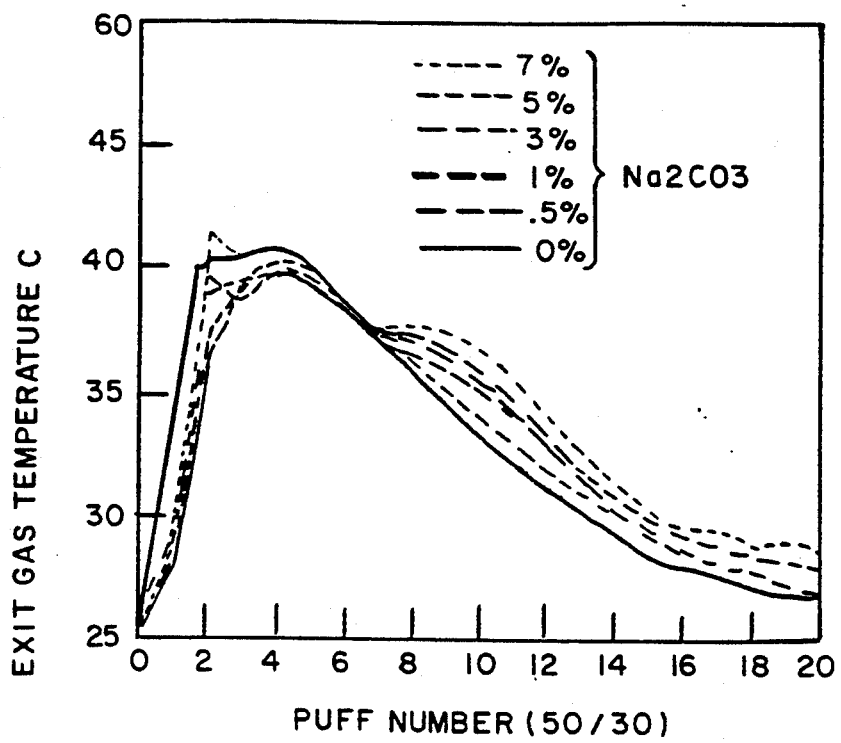
FIG. 8 illustrates the exit gas temperature from the mouthend pieces of the cigarettes utilizing FIG. 1A fuel elements prepared with various levels of added $Na_2CO_3$ in aqueous solutions (0%, 0.5%, 1.0%, 3.0%, 5.0% and 7.0%).

The plots of the exit gas temperature from the mouthend pieces of the cigarettes of Example 6 are shown in FIG. 8. The aerosol temperatures of all samples are about 40° C. or less depending upon the puff number. It will be noted from FIG. 8 however, that additions of sodium carbonate to the fuel element does result in higher aerosol temperatures in the later puffs when compared to the controls.

Figure 9:
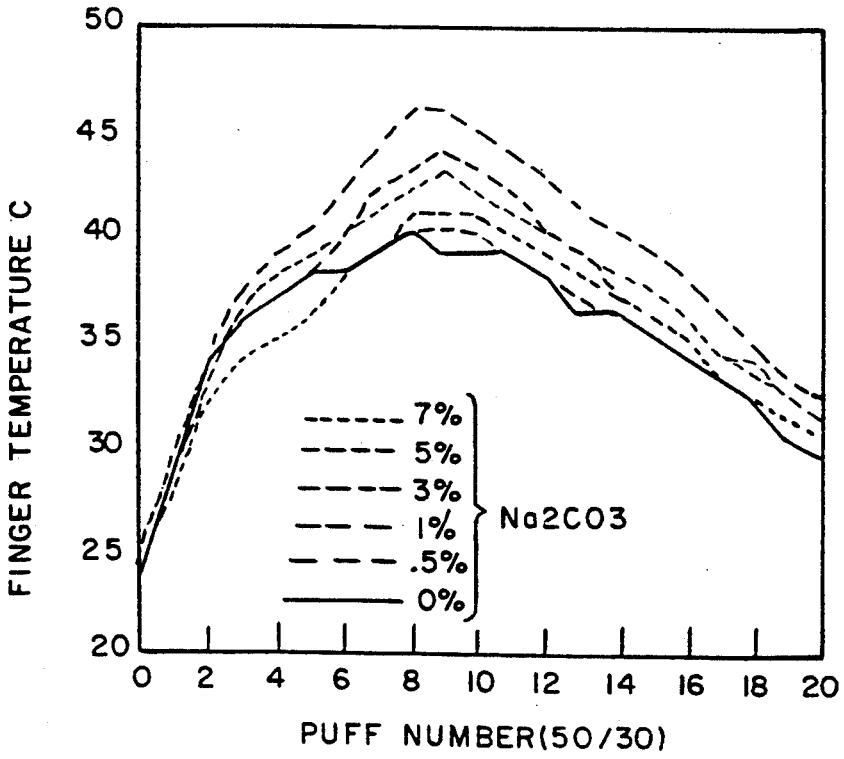
FIG. 9 shows the finger temperatures of the cigarettes prepared with FIG. 1A fuel elements prepared with various levels of added $Na_2CO_3$ in aqueous solutions (0%, 0.5%, 1.0%, 3.0%, 5.0% and 7.0%).

The plots of the various finger temperatures of the cigarettes of Example 6 are shown in FIG. 9. The finger temperature is measured by placing a thin wire thermocouple on the mouthend piece of the cigarette at a point about 20 mm from the mouth end of the filter. FIG. 9 shows that the finger temperatures increase as the sodium solution strength increases up to a 3.0% level. Higher levels of added sodium carbonate then result in a decrease in finger temperature. All values of finger temperature shown in FIG. 9 are remarkably low compared to typical measured values of about 75° C. in the Reference Cigarette.

The $CO/CO_2$ yields from cigarettes of Example 6 containing varying levels of sodium carbonate were measured both on a puff by puff basis using the 50/30 puffing conditions and by the standard FTC method (35 cc puff volume, 2 sec. duration; separated by 58 seconds of smolder).

A summary of the 50/30 test CO yields and the corresponding FTC test CO yields is given below in Table 4. It can be seen from this table that the FTC CO yields are relatively low.

TABLE 4

FTC and 50/30 CO Yields Per Puff

| % added $Na_2CO_3$ Solution % | Na Content (ppm) | 50/30 CO (mg) | FTC CO (mg) |
|---|---|---|---|
| 0.0 | 1120 | 14.8 | 5.4 |
| 0.5 | 2234 | 18.3 | 6.4 |
| 1.0 | 3774 | 21.0 | 7.6 |
| 3.0 | 8691 | 21.1 | 9.1 |
| 5.0 | 13150 | 22.5 | 9.7 |
| 7.0 | 17420 | 24.1 | 10.0 |

Likewise, a summary of both the 50/30 test and FTC test $CO_2$ yields is given in Table 5.

TABLE 5

FTC and 50/30 $CO_2$ Yields Per Cigarette

| % added $Na_2CO_3$ Solution % | Na Content (ppm) | 50/30 $CO_2$ (mg) | FTC $CO_2$ (mg) |
|---|---|---|---|
| 0.0 | 1120 | 56.0 | 22.1 |
| 0.5 | 2234 | 62.1 | 24.6 |
| 1.0 | 3774 | 61.7 | 24.7 |
| 3.0 | 8691 | 58.4 | 23.9 |
| 5.0 | 13150 | 54.5 | 21.8 |
| 7.0 | 17420 | 54.7 | 21.4 |

Figure 10:
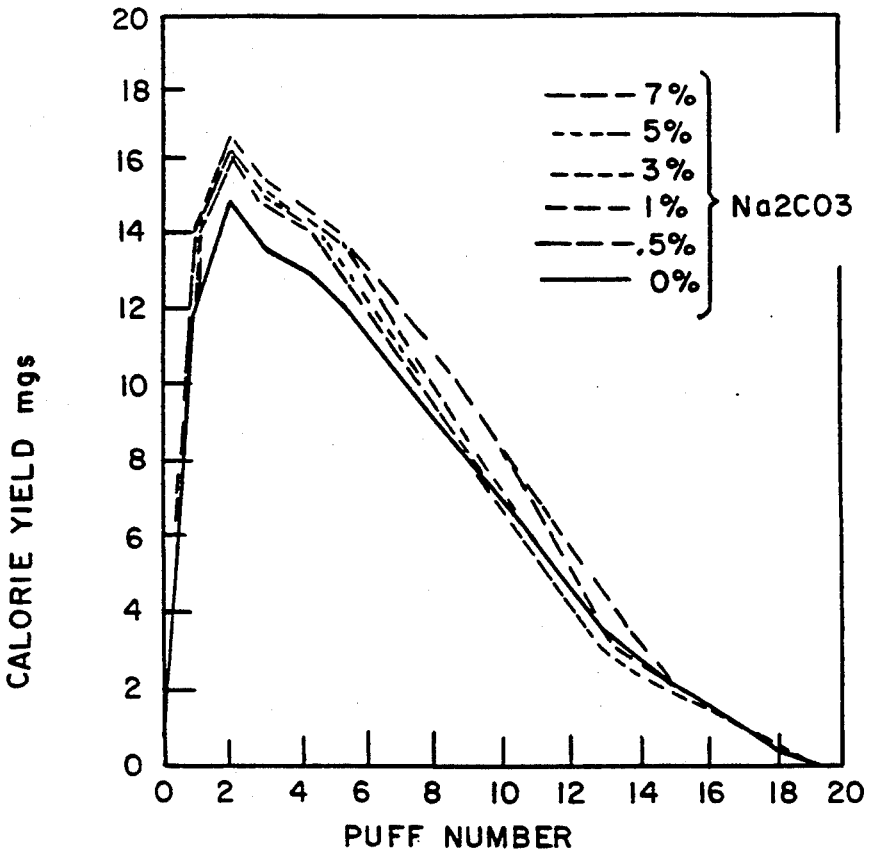
FIG. 10 illustrates the puff by puff calorie curves generated by the FIG. 1A fuel elements prepared with various levels of added $Na_2CO_3$ in aqueous solutions (0%, 0.5%, 1.0%, 3.0%, 5.0% and 7.0%).

The $CO/CO_2$ yield data presented above can be used to calculate both the puff by puff and total yields of convective thermal energy produced by the fuel elements. Shown in FIG. 10 are the puff by puff calorie curves generated by the different fuel elements when smoked at 50/30 test smoking conditions. FIG. 10 shows that additions of sodium carbonate to the fuel elements results in an increase in the convective energy particularly during the first 8 puffs.

The total calorie output of the fuel elements under the 50/30 and FTC smoking conditions are summarized in Table 6.

TABLE 6

FTC and 50/30 Calorie Yields

| % added $Na_2CO_3$ Solution % | Na Content (ppm) | 50/30 Calories | FTC Calories |
|---|---|---|---|
| 0.0 | 1120 | 117.3 | 52.4 |
| 0.5 | 2234 | 148.0 | 58.6 |
| 1.0 | 3774 | 153.5 | 60.0 |
| 3.0 | 8691 | 143.9 | 59.7 |
| 5.0 | 13150 | 139.3 | 55.8 |
| 7.0 | 17420 | 138.2 | 55.2 |

Figure 11:
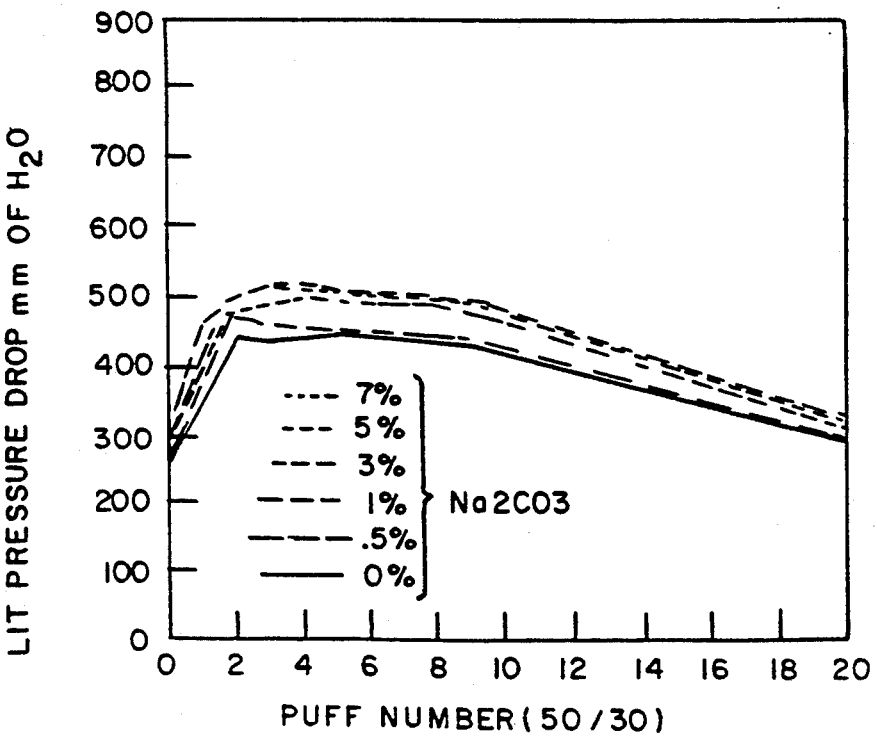
FIG. 11 provides the lit pressure drops obtained from cigarettes of FIG. 1 while smoking at 50 cc/30 sec conditions with the FIG. 1A fuel elements prepared with various levels of added $Na_2CO_3$ in aqueous solutions (0%, 0.5%, 1.0%, 3.0%, 5.0% and 7.0%).

Shown in FIG. 11 are the lit pressure drops obtained from the cigarette while smoking using the 50/30 smoking conditions. FIG. 11 shows that all of the cigarettes of Example 6 tested exhibited lit pressure drops below 500 mm of water. The addition of sodium carbonate to the fuel elements resulted in an increase in lit pressure drop of up to 100 mm of $H_2O$ depending upon the level of sodium carbonate added compared to the control.

Table 7 represents a comparison of the performance characteristics of three identical cigarettes, except that three different binders were employed in forming the fuel elements; (1) SCMC (no added Na); (2) ammonium alginate (no added Na); and (3) ammonium alginate with 3% $Na_2CO_3$ solution added).

The differences in the performance of these three cigarettes can immediately be observed.

TABLE 7

Comparison of Cigarette Attributes Made with Fuel Elements having binders of (1) all-SCMC, (2) all-Ammonium Alginate, and (3) Ammonium Alginate mixed with a 3% $Na_2CO_3$ Solution

| Attribute | all-SCMS | all-Am. Alginate | Am. Alginate & 3.0% $Na_2CO_3$ |
|---|---|---|---|
| Peak Puff Temp °C. | 930 | 885 | 885 |
| Backside Temp °C. | 440 | 240 | 260 |
| 11 mm Capsule Temp °C. | 202 | 163 | 204 |
| Capsule EGT °C. | 132 | 57 | 78 |
| MEP EGT °C. | 37 | 37 | 42 |
| Finger Temp °C. | 47 | 40 | 46 |
| FTC CO Yield mg | 7.7 | 5.4 | 9.1 |
| FTC $CO_2$ Yield mg | 31.7 | 22.1 | 23.9 |
| 50/30 CO Yield mg | 19.5 | 14.8 | 21.4 |
| 50/30 $CO_2$ Yield mg | 72.2 | 56.0 | 57.8 |
| Puff Calories cals | 172.7 | 117.3 | 143.8 |
| Smolder Loss 5 min mg | 62.3 | 21.9 | 56.0 |
| % Non-Lighting | 40 | 100 | 10 |

*EGT = Exit Gas Temperature.

The puff by puff aerosol densities of cigarettes of Example 6 incorporating fuel elements with varying levels of sodium carbonate added to their microstructure were obtained by smoking the cigarettes on a smoking machine using 50/30 smoking conditions. The density of aerosol from the mouth end piece was measured by passing the aerosol through a photometer.

Figure 12:
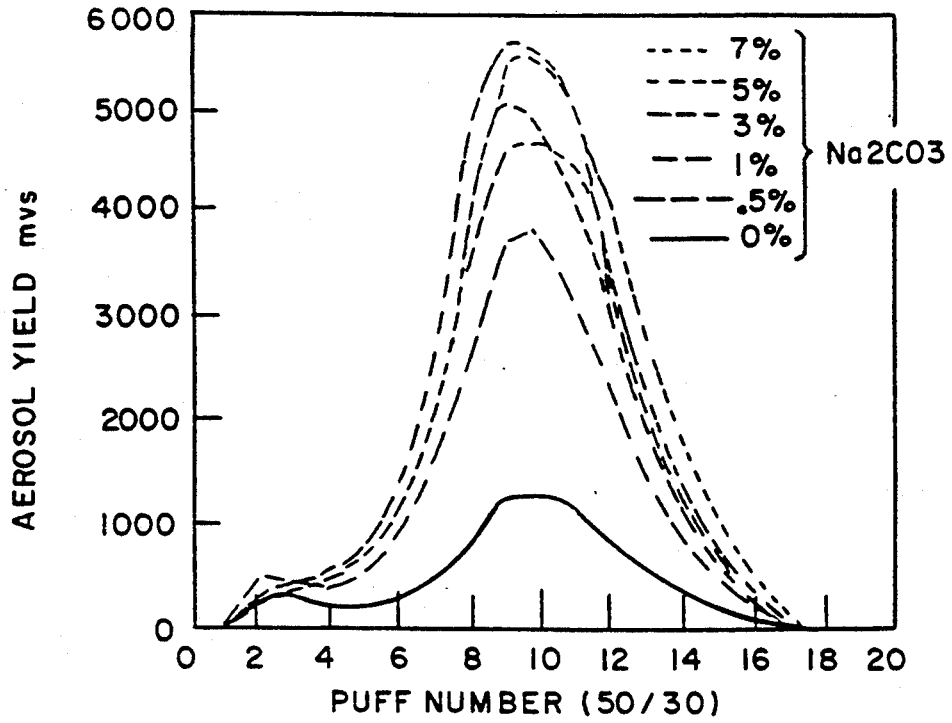
FIG. 12 illustrates the puff by puff plots of aerosol densities for the cigarettes of FIG. 1 while smoking at 50 cc/30 sec conditions with the FIG. 1A fuel elements prepared with various levels of added $Na_2CO_3$ in aqueous solutions (0%, 0.5%, 1.0%, 3.0%, 5.0% and 7.0%).

FIG. 12 illustrates the puff by puff plots of aerosol densities for the cigarettes with the six different types of fuel elements. From FIG. 12 it can be seen that the control (0% added $Na_2CO_3$) fuel element results in very little aerosol generation from the cigarette. The addition of even small amounts of sodium carbonate to the fuel elements results in dramatic increases in aerosol density. Fuel elements produced with 1.0% sodium carbonate solutions result in a 400% increase in total aerosol yield.

Figure 13:
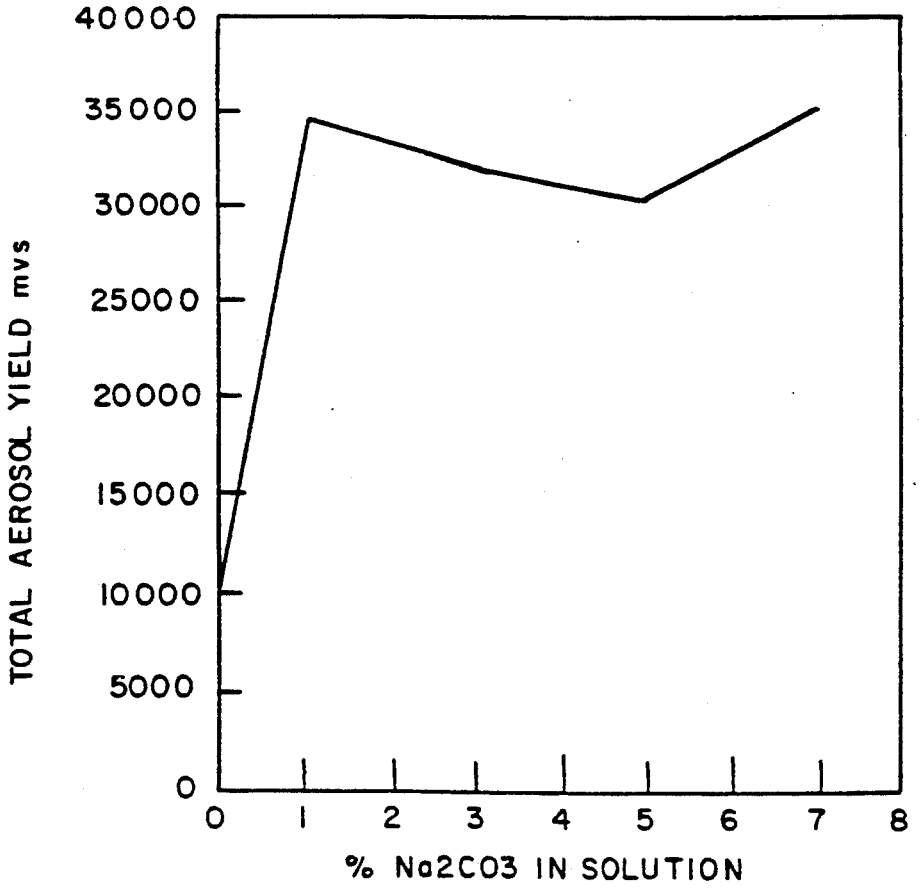
FIGS. 13, and 14 illustrate the total aerosol yields versus the sodium carbonate solution strength and the actual parts per million of sodium in each of the fuel elements, respectively.
Figure 14:
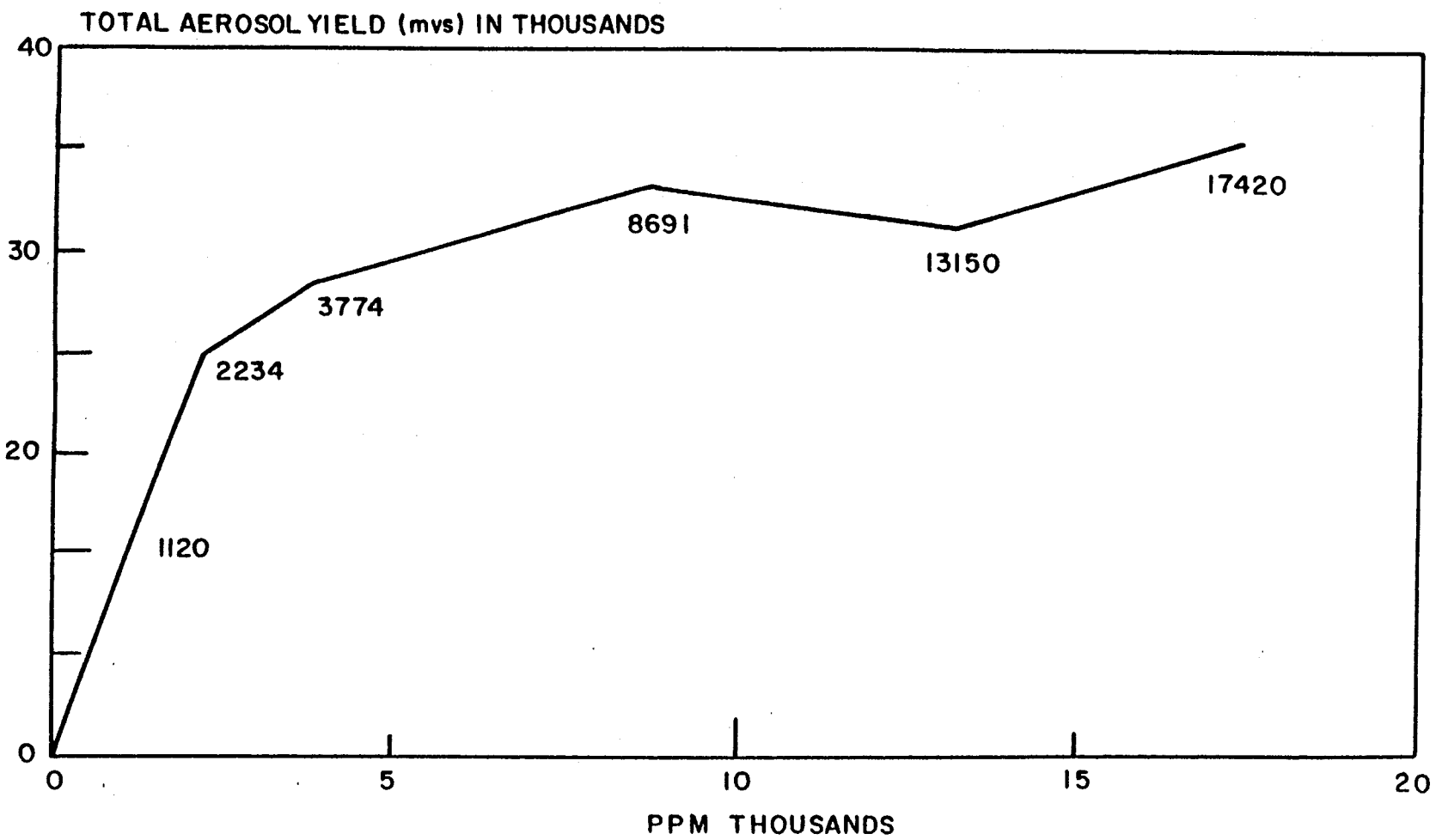

This can be seen even more clearly by examining FIGS. 13 and 14 where the total aerosol yields have been plotted as a function of the sodium carbonate solution strength and the actual parts per million of sodium in each of the fuel elements, respectively.

Figure 15:
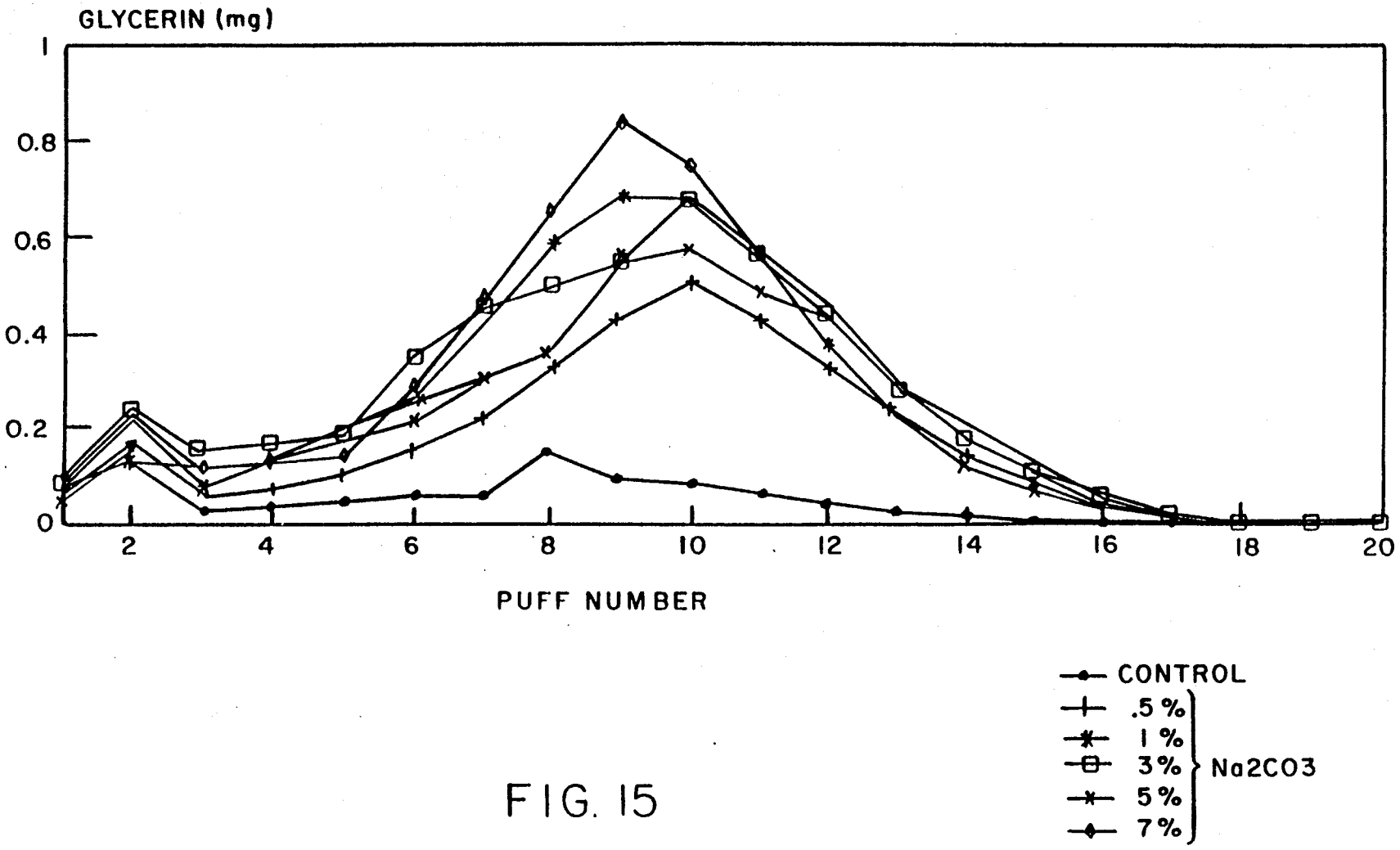
FIGS. 15 and 16 respectively represent the puff by puff glycerin and nicotine yields for cigarettes of FIG. 1 while smoking at 50 cc/30 sec conditions with the FIG. 1A fuel elements prepared with various levels of added $Na_2CO_3$ in aqueous solutions (0%, 0.5%, 1.0%, 3.0%, 5.0% and 7.0%).

Yields of aerosol components and flavorants (e.g., glycerin and nicotine) were obtained from the cigarettes of Example 6 using 50/30 smoking conditions. FIG. 15 represents the puff by puff glycerin yields. An examination of FIG. 15 reveals that the cigarettes utilizing the control fuel element produce significantly less glycerin yields than those utilizing the fuel elements with sodium carbonate additive.

Figure 16:
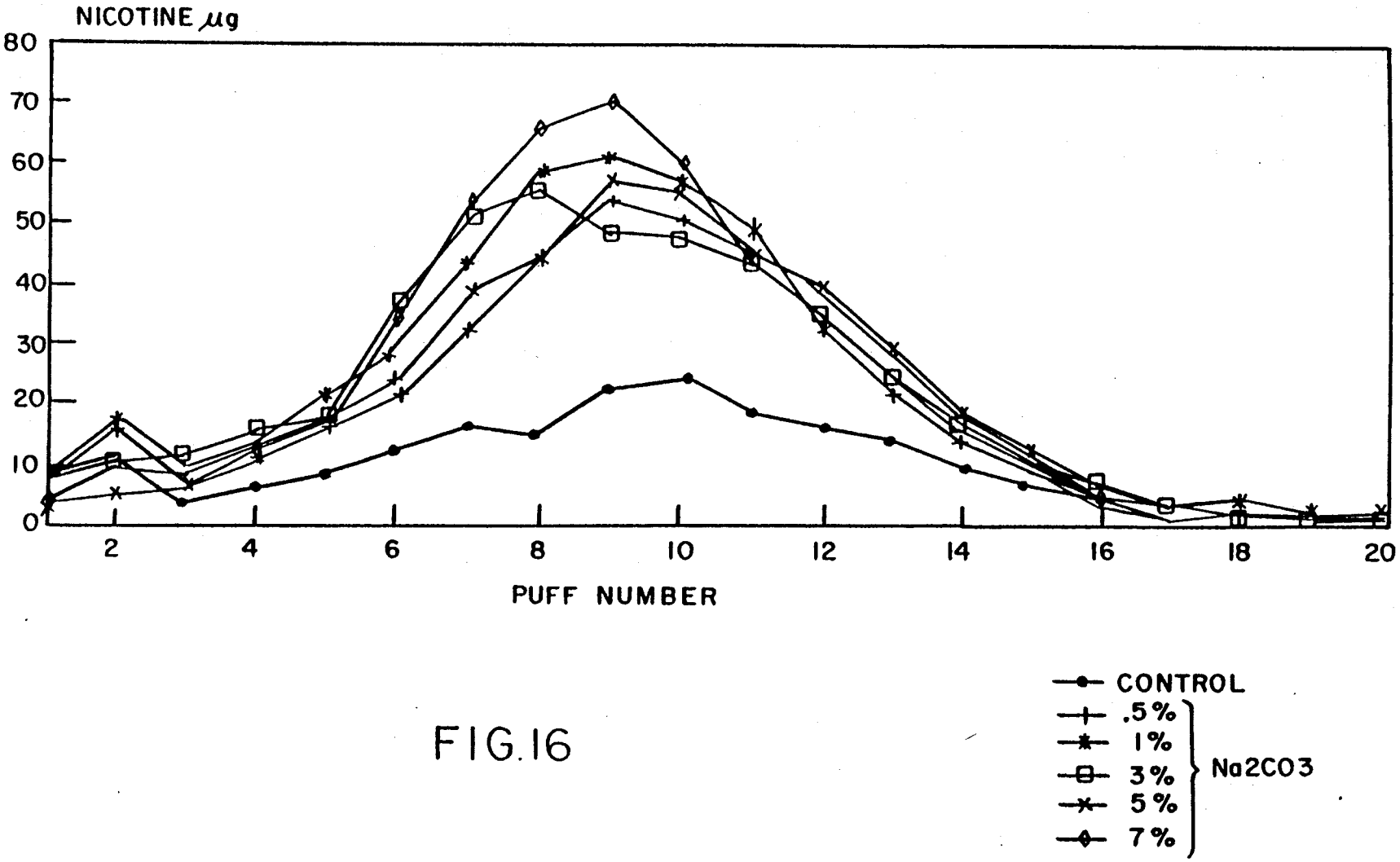

The same behavior can be seen with regard to the nicotine yields shown in FIG. 16.

EXAMPLE 8

Asparagine (the preferred ammonia releasing compound), added to the fuel mixture at levels varying from 0% to 3% was found to reduce formaldehyde levels in the combustion products of cigarettes by up to more than 70%.

EXAMPLE 8A

Reference-type cigarettes with tobacco/carbon fuel elements were prepared with the following component parts:

Substrate

| | |
|---|---|
| Alumina | 44.50 |
| Carbon | 15.00 |
| SCMC | 0.50 |
| Blended tobacco particles | 10.00 |
| Cased, heat treated tobacco particles | 10.00 |
| Glycerin | 20.00 |

Fuel Element (10×4.5 mm; 5-slots, inserted 3 mm)

| | | | | |
|---|---|---|---|---|
| Carbon (Calgon C5) | 77.00 | 76.00 | 75.00 | 74.00 |
| SCMC binder | 8.00 | 8.00 | 8.00 | 8.00 |
| Tobacco particles | 15.00 | 15.00 | 15.00 | 15.00 |
| asparagine | 0.00 | 1.00 | 2.00 | 3.00 |

Mouthend Piece:

10 mm void space; 10 mm tobacco paper; 20 mm polypropylene filter segment

Tobacco Roll blend of puffed tobaccos

Insulating Jacket 15 mm Owens-Corning "C" Glass

Overwrap Paper

KC-1981-152

Smoking Results—Levels of Measured Formaldehyde

| % Asparagine | Formaldehyde Level |
|---|---|
| 0 | 24.3 μg/cigarette |
| 1 | 18.9 μg/cigarette |
| 2 | 11.1 μg/cigarette |
| 3 | 6.4 μg/cigarette |

EXAMPLE 8B

Reference-type cigarettes with tobacco/carbon fuel elements were prepared with the following component parts:

Marumerized Substrate

| | |
|---|---|
| Alumina | 44.50 |
| Carbon | 15.00 |
| SCMC | 0.50 |
| Blended tobacco particles | 10.00 |

-continued

| | |
|---|---|
| Cased, heat treated tobacco particles | 10.00 |
| Glycerin | 20.00 |

Fuel Element (10 mm×4.5 mm; 6-slots, inserted 3 mm)

| | | | | |
|---|---|---|---|---|
| Carbon (hardwood) | 89.10 | 88.10 | 87.10 | 86.10 |
| Amm. Alginate | 10.00 | 10.00 | 10.00 | 10.00 |
| $Na_2CO_3$ | 0.90 | 0.90 | 0.90 | 0.90 |
| asparagine | 0.00 | 1.00 | 2.00 | 3.00 |

Mouthend Piece 10 mm void space; 10 mm tobacco paper; 20 mm polypropylene filter segment Tobacco Roll blend of puffed tobaccos Insulating Jacket 15 mm Owens-Corning "C" Glass Overwrap Paper

KC- 1981-152

Smoking Results—Levels of Measured Formaldehyde

| % Asparagine | Formaldehyde Level |
|---|---|
| 0 | 12.8 μg/cigarette |
| 1 | 10.7 μg/cigarette |
| 2 | 6.2 μg/cigarette |
| 3 | 2.6 μg/cigarette |

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A carbonaceous fuel composition for fuel elements of smoking articles, said composition comprising an intimate admixture of:

(a) from about 80 to 99 weight percent carbon;

(b) from about 1 to 20 weight percent of a binder; and (c) a final sodium (Na) level of from about 3000 to about 20,000 ppm.

2. The fuel composition of claim 1, wherein the binder comprises a non-sodium based binder having an inherent level of sodium below about 1500 ppm.

3. The fuel composition of claim 1, wherein the binder comprises a low-sodium binder having an inherent level of sodium below about 3000 ppm.

4. The fuel composition of claim 1, wherein the binder comprises a mixture of a sodium salt binder and a low-sodium binder having an sodium content below about 3000 ppm.

5. The fuel composition of claim 1, wherein the binder comprises a mixture of a sodium salt binder and a non-sodium binder having an sodium content below about 3000 ppm.

6. The fuel composition of claim 1, 2, 3, 4, or 5, further comprising a sodium compound selected from the group consisting of sodium carbonate; sodium acetate, sodium oxalate, and sodium malate.

7. The fuel composition of claim 6, wherein the sodium compound is an aqueous solution ranging from about 0.1 to about 10 percent by weight.

8. The fuel composition of claim 7, wherein the sodium compound is an aqueous solution ranging from about 0.5 to about 7 percent by weight.

9. The fuel composition of claim 1, 2, 3, 4, or 5, which further includes a non-burning filler material.

10. The fuel composition of claim 9, wherein the filler material is calcium carbonate or agglomerated calcium carbonate.

11. The fuel composition of claim 1, 2, 3, 4, or 5, wherein the non-sodium or low-sodium binder is an alginate binder.

12. The fuel composition of claim 9, wherein the alginate binder is ammonium alginate.

13. A carbonaceous fuel composition for fuel elements of smoking articles, said composition comprising an intimate admixture of:

(a) from about 60 to 99 weight percent carbon;

(b) from about 1 to 20 weight percent of a binder;

(c) from about 1 to 20 weight percent tobacco; and (d) a final sodium (Na) level of from about 3000 to about 20,000 ppm.

14. The fuel composition of claim 13, wherein the binder comprises a non-sodium based binder having an inherent level of sodium below about 1500 ppm.

15. The fuel composition of claim 13, wherein the binder comprises a low-sodium binder having an inherent level of sodium below about 3000 ppm.

16. The fuel composition of claim 13, wherein the binder comprises a mixture of a sodium salt binder and a low-sodium binder having an sodium content below about 3000 ppm.

17. The fuel composition of claim 13, wherein the binder comprises a mixture of a sodium salt binder and a non-sodium binder having an sodium content below about 3000 ppm.

18. The fuel composition of claim 13, 14, 15, 16, or 17, further comprising a sodium compound selected from the group consisting of sodium carbonate sodium acetate, sodium oxalate, and sodium malate.

19. The fuel composition of claim 18, wherein the sodium compound is an aqueous solution ranging from about 0.1 to about 10 percent by weight.

20. The fuel composition of claim 19, wherein the sodium compound is an aqueous solution ranging from about 0.5 to about 7 percent by weight.

21. The fuel composition of claim 13, 14, 15, 16, or 17, which further includes a non-burning filler material.

22. The fuel composition of claim 21, wherein the filler material is calcium carbonate or agglomerated calcium carbonate.

23. The fuel composition of claim 13, 14, 15, 16, or 17, wherein the non-sodium or low-sodium binder is an alginate binder.

24. The fuel composition of claim 21, wherein the alginate binder is ammonium alginate.

25. A fuel element for smoking articles, said fuel element comprising an extruded composition comprising an intimate admixture of:

(a) from about 80 to 99 weight percent carbon;

(b) from about 1 to 20 weight percent of a binder; and (c) from about 3500 to about 9,000 ppm sodium carbonate.

26. The fuel composition of claim 25, wherein the binder is an alginate binder.

27. The fuel composition of claim 26, wherein the alginate binder is ammonium alginate.

28. A method of increasing the smolder rate of a burning carbonaceous fuel element prepared from a composition comprising a mixture of carbon and a binder;

said method comprising the step of adjusting the sodium content of the fuel element composition mixture by adding an aqueous solution of a sodium compound selected from the group consisting of sodium carbonate, sodium acetate, sodium oxalate, and sodium malate, thereto such that the final sodium content thereof is between about 3000 and about 9000 ppm.

29. The method of claim 28, wherein the binder is an alginate binder.

30. The method of claim 29, wherein the alginate binder is ammonium alginate.

31. A method of reducing the puff temperature of a burning carbonaceous fuel element prepared from a composition comprising a mixture of carbon and a binder;

said method comprising the step of adjusting the sodium content of the fuel element composition mixture by adding an aqueous solution of a sodium compound selected from the group consisting of sodium carbonate, sodium acetate, sodium oxalate, and sodium malate, thereto such that the final sodium content thereof is between about 6500 and about 10,000 ppm.

32. The method of claim 31, wherein the binder is an alginate binder.

33. The method of claim 32, wherein the alginate binder is ammonium alginate.

34. A method of increasing the smolder temperature of a burning carbonaceous fuel element prepared from a composition comprising a mixture of carbon and a binder;

said method comprising the step of adjusting the sodium content of the fuel element composition mixture by adding an aqueous solution of a sodium compound selected from the group consisting of sodium carbonate, sodium acetate, sodium oxalate, and sodium malate, thereto such that the final sodium content thereof is between about 3000 and about 10,000 ppm.

35. The method of claim 34, wherein the binder is an alginate binder.

36. The method of claim 35, wherein the alginate binder is ammonium alginate.

37. A method of increasing the smolder temperature of a burning carbonaceous fuel element prepared from a composition comprising a mixture of carbon and a binder;

said method comprising the step of adjusting the sodium content of the fuel element composition mixture by adding an aqueous solution of a sodium compound selected from the group consisting of sodium carbonate, sodium acetate, sodium oxalate, and sodium malate, thereto such that the final sodium content thereof is 2500 and about 10,000 ppm.

38. The method of claim 37, wherein the binder is an alginate binder.

39. The method of claim 38, wherein the alginate binder is ammonium alginate.

40. A smoking article comprising:

a carbonaceous fuel composition for fuel elements of smoking articles, said composition comprising an intimate admixture of:

(a) from about 80 to 99 weight percent carbon;

(b) from about 1 to 20 weight percent of a binder; and (c) from about 2000 to about 10,000 ppm sodium carbonate; and a physically separate aerosol generating means longitudinally disposed behind said fuel element, said aerosol generating means including an aerosol forming material.

41. The smoking article of claim 40, wherein the binder is an alginate binder.

42. The smoking article of claim 41, wherein the alginate binder is ammonium alginate.

43. The smoking article of claim 40, 41, or 42, which is a cigarette.

* * * * *